United States Patent [19]

Dahnert

[11] Patent Number: 4,733,923

[45] Date of Patent: Mar. 29, 1988

[54] MOVABLE STORAGE UNIT CONTROL SYSTEM

[75] Inventor: Dean L. Dahnert, Fort Atkinson, Wis.

[73] Assignee: Spacesaver Corporation, Fort Atkinson, Wis.

[21] Appl. No.: 904,541

[22] Filed: Sep. 8, 1986

[51] Int. Cl.[4] ..... H01H 47/00; A47B 53/00

[52] U.S. Cl. ..... 312/201; 361/189; 361/179

[58] Field of Search ..... 312/198–201

[56] References Cited

U.S. PATENT DOCUMENTS 4,119,376 10/1978 Moyer ..... 312/199

4,437,711 3/1984 Dahnert ..... 312/201

*Primary Examiner*—L. T. Hix

*Assistant Examiner*—David Porterfield

*Attorney, Agent, or Firm*—Fuller, Puerner & Hohenfeldt

[57] ABSTRACT

A movable storage unit control system is provided with: a leading edge safety tape switch for contacting it to bring a driven unit to a stop; a processor for generating move and stop command signals; a plurality of circuits through which test signals are transmitted under control of the processor and which are returned to the processor coincidentally with their transmission through a current sensor if the circuit tests good; a procedure for having the processor address a test signal to a nonexistent circuit to determine if the current sensor has failed and is allowing return of signals when it should not; circuits for setting minimum and maximum speed of the motors that drive the storage units; a circuit for setting the intensity of dynamic braking of the drive motors; and, a watchdog circuit that shuts down the processor upon occurrence of intense temporary electrical noise or software execution errors and is involved in causing the processor to shut down and block all commands to the system if the processor or other hardware fails.

3 Claims, 5 Drawing Figures

MOVABLE STORAGE UNIT CONTROL SYSTEM

BACKGROUND OF THE INVENTION

This invention pertains to movable storage systems wherein a series of storage units having shelves or bins, for example, are movable on tracks to create an access aisle between two of the units and to establish the others in close side-by-side relationship to minimize the amount of floor space required for the units. In particular, the invention resides in enhancing the fail-safe features of the electrical control system that governs automatic positioning of the storage units in response to a user request and that monitors safety conditions and the integrity of the system. The control system is an improvement over U.S. Pat. No. 4,437,711 whose entire disclosure is incorporated herein by reference. The patent is owned by the assignee of this application.

Typically, the storage units are mounted on track guided wheeled carriages each of which has at least one reversible electric motor propelling it bidirectionally on tracks or rails which may be recessed in the floor. Usually, at least one outermost unit in the series is stationary and other units are controlled to move toward and away from it to form aisles.

The storage unit system described in the cited patent uses a microprocessor based controller to bring about movement of the storage units in the proper directions in response to a user initiated command to open a particular aisle between units. The processor also monitors conditions that have to do with safe operation of the equipment.

In the prior system, the movable storage units are provided on each side with basically conventional safety sweep bars. These bars extend over the length of the sides of the units that face the adjacent units and aisles and they are invariably mounted near the floor so that if an obstruction, such as a person or an article, is encountered by a sweep bar of a moving unit, the sweep bar will open a plurality of series connected switches which will be sensed by the processor. The processor responds by causing the carriage drive motors on all of the storage units to be deactivated until the obstruction lying on the floor is cleared and the system is reset. Safety sweep bars and switches have been used in movable storage unit systems having controllers based on relay logic as well as in microprocessor based controllers such as were pioneered in the cited patent.

Conventional safety sweep switches are suitable for stopping storage unit motion when an inanimate obstruction lying on the floor is encountered. The safety sweep switches will also protect a person against injury by stopping storage unit motion if a control circuit failure or a person who is careless presses a start button to open an aisle at the peril of the preceding user who is presently in an open aisle. The sweep bar on the moving unit will, of course, strike the foot or lower portion of the person in the aisle or the person in the aisle might have the presence of mind to swing his or her foot into a sweep bar to stop the unit before it could press against the upper portion of the person's body. In any case, a person in an aisle is certain to experience substantial consternation during the time which it takes to react by swinging a foot into the safety sweep bar or just having the bar press against the person if the person was close enough to the bar at the instant the units began to move. As applicant has perceived, what these systems need is a safety shutdown switch arrangement which is located on the leading edge on the movable storage units and which is at a higher elevation than the safety sweep bars so that a person would be contacted higher up on the body and so that a person in an aisle could conveniently touch by hand, or by means of an article in the person's hand, a leading edge switch that could be contacted every inch of the way along the length of each side of the storage units.

Another problem in processor based control systems is to assure that failures in the hardware or software used in the system will result in shutting down the system if its self-testing procedure indicates a permanent fault has occurred and not shutting down the system if a hardware or software fault is simulated by high level electronic noise being injected into the system. There should be some means for shutting down the system until it is manually reset for every conceivable failure that is anything but a transient failure.

Another problem in the realm of safety in prior storage unit systems is providing for smooth acceleration and deceleration and thus the right amount of braking of the units following deenergization of the carriage drive motors to bring the units to a stop at such rate as to not cause the carriage wheels to skid or the storage unit to topple as would be the case if braking is too intense. Heretofore, manufacturers would use on all storage systems having the same capacity the same type of brake. Thus, there would be cases where the units were loaded very heavily and other cases where they were loaded lightly. The braking force applied might have been appropriate for the more lightly loaded units but not for the heavier units. No means have been provided heretofore to improve safety by permitting selection of the braking intensity at the installation site commensurate with the load that will be carried by the storage units.

SUMMARY OF THE INVENTION

In accordance with one feature of the invention, a leading edge switch that is intermediate of the bottom and top of a storage unit extends over the length of a side of a storage unit and causes the controller to respond to a person or object touching the switch by stopping movement of the storage unit. In particular, the leading edge switch is a tape switch designed to be normally open but is incorporated in a novel circuit which causes it to function as if it were normally closed.

Another important feature is to incorporate in the controller a protector circuit (hereafter called a watchdog circuit) which causes the processor to respond to one type of fault, such as the circuit being swamped by interfering electronic noise, by shutting down momentarily for allowing the processor to resynchronize and then to attempt to reinitiate the electronic circuitry so as to reinstate the processor instructions or code in its normal sequence and attempt to restart operation repeatedly until the fault clears. An adjunct to this object is to adapt the watchdog circuit for monitoring the processor itself and its peripherals for failures or errors and then to block the outputs of an external latch through which the processor would normally provide commands such as "move left" or "move right" to the controllers on the individual storage units so that if the processor program or instruction set crashes the system will become completely inactivated.

A further feature of the invention is to provide for having the controller control the deceleration and acceleration of the carriage drive motors for each direction of rotation and at the same time provide for permitting setting all carriage drive systems to the same speed so as the storage units begin to move in an aisle opening operation one unit will not overtake another until execution of the aisle opening procedure is complete at which time limit switches on the units initiate braking. A correlative of the manner in which the motor speed control is integrated into the processor controller is to provide means for adjusting carriage motor dynamic braking to an intensity appropriate to the mass of a storage unit and its contents in any particular installation.

How the foregoing and other features of the improved movable storage unit control system are achieved will be evident in the ensuing description of a preferred embodiment of the invention which will now be set forth in reference to the drawings.

DESCRIPTION OF A PREFERRED EMBODIMENT

Figure 1:
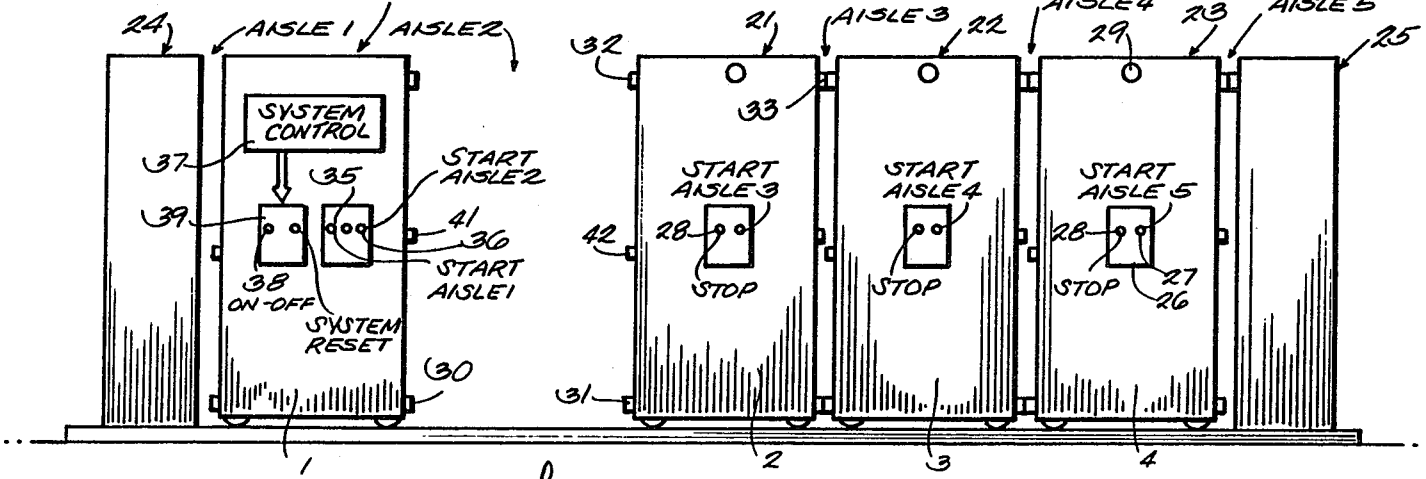
FIG. 1 is a diagram of a plurality of movable storage units among which some of the units are in contact with each other and one pair of the units are separated from each other to provide an aisle to give the user access to the shelves or bins on the sides of the units.

FIG. 1 is a front elevation diagram of several storage units that are arranged to move alternately and selectively to the left and right as depicted to establish an access aisle between them at the command of a user. The tracks on which the units move and the wheels on which they move are not shown in FIG. 1. The tracks can be in the form illustrated in U.S. Pat. No. 3,640,595 whose entire disclosure is incorporated herein by reference. In the FIG. 1 installation, there are four movable storage units 20–23 arranged to move rectilinearly relative to each other to establish an access isle between any two of them. Optionally used stationary storage units 24 and 25 are also shown. Some installations include only one stationary storage unit at one boundary of the system and a wall constitutes the other boundary. Units 21, 22 and 23 are presently parked and are closely adjacent each other such that no usable aisle space exists between them. Aisle 2, existing between units 20 and 21, is fully open to provide access by a person to the right and left sides of storage units 20 and 21, respectively. The storage units will be understood to be elongated in the direction perpendicular to the drawing to provide shelves or other storage compartments for books, files or articles of any kind. It should be understood at the outset that the improved control system described herein is adapted for controlling a system that has fewer or more storage units than are depicted in FIG. 1. Lights such as the one marked 29 in FIG. 1 turn on when the storage units are moving.

Storage units 21, 22 and 23 and the slave controllers on them are identical in all respects. A typical unit 23 has a controller, represented by the rectangle marked 26, mounted on it. Normally the slave controller would be concealed from view and only a "start" push button switch 27 that is pressed by the user to initiate the aisle opening procedure would be visible and accessible. Also accessible to the user is a "stop" push button switch marked 28. This switch is pressed by the user when circumstances dictate the desirability of making an emergency stop while the storage units are in motion.

There is a yieldable safety sweep switch bar, such as those marked 30 and 31 on unit 23 on each side of each movable unit. These safety sweep bars extend over the length of a storage unit on each side and actuate safety sweep switches which cause motion of the storage units to be inhibited if an obstacle or impediment to their movement is encountered. The safety sweep bars and their switches will be described later in greater detail. There are also limit switches such as those marked 32 and 33 on each side of a movable storage unit for sensing when a storage unit is in proximity with an adjacent unit for terminating an aisle opening operation.

In FIG. 1, storage unit 20 carries a system controller or master controller 37. The master storage unit is the only one that has two start switches 35 and 36. The other movable storage units 21–23 only need one. The controllers are so designed that they decide in response to operation of a start switch which unit should move first and in which direction the units must move in one direction or the other or both directions to open an aisle. Pressing start push button switch 35 associated with master controller and storage unit 20 causes the storage units to be driven in a direction for opening aisle 1 and closing presently open aisle 2. The other start push button switch 36 may be pressed to open aisle 2 if the storage unit 21 was up against storage unit 20. The system controller on storage unit 20 is labeled "system control" and indicated further by the reference numeral 37. A key operated switch 38 is made accessible to the user for energizing or turning the system on and off to prevent unauthorized operation of the system. The controls are not energized unless the key switch 38 is in its on state. A system reset switch 39 is also provided and is used when the system is energized to assure that the digital electronic components in the controllers are properly initialized.

The new leading edge or safety tape switches are shown as squares in FIG. 1 as if viewed from their ends and illustrative tape switches are marked 41 and 42. It will be evident that each of the movable storage units has a leading edge tape switch mounted to it. The novel manner in which the leading edge switches are incorporated in the controller circuits and the manner in which they coact with the safety sweep switches will be described in greater detail later. The manner in which the controller tests the integrity and tests for the fail-safe properties of the safety sweep switches in conjunction with the leading edge switches will also be described later.

Figure 3:
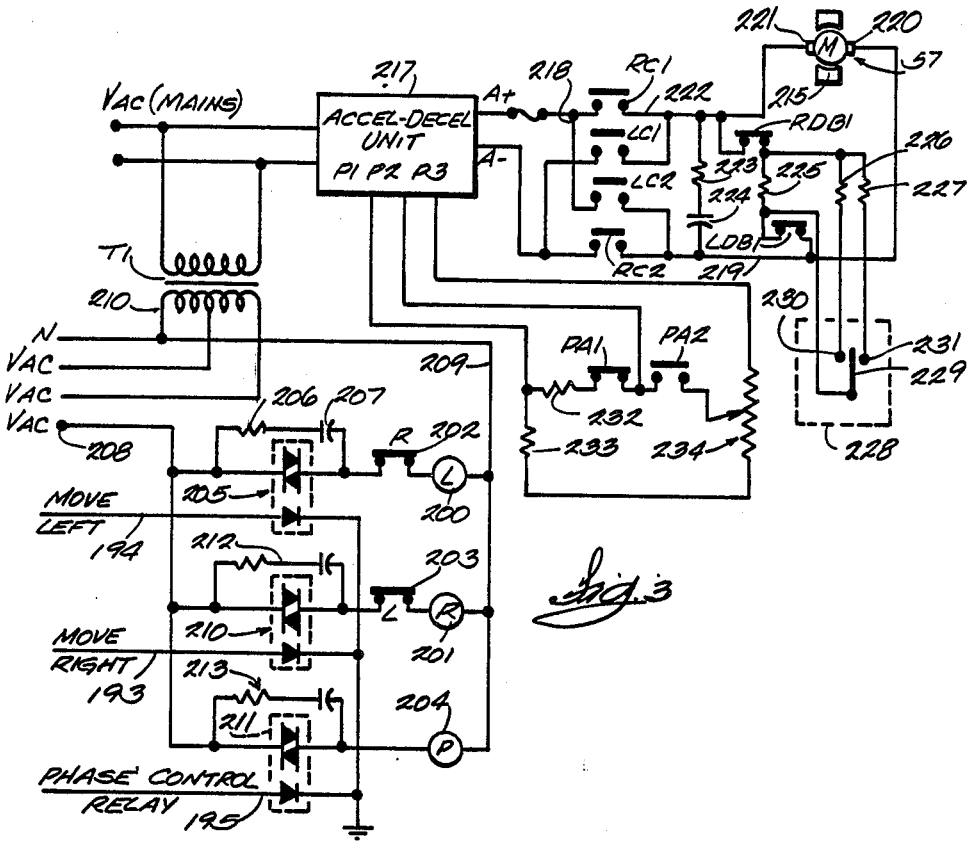
FIG. 3 is a diagram of one of the circuits on a carriage involved with controlled acceleration and deceleration of the carriage unit drive motors and also with travel direction selection and dynamic braking intensity adjustment.
Figure 4:
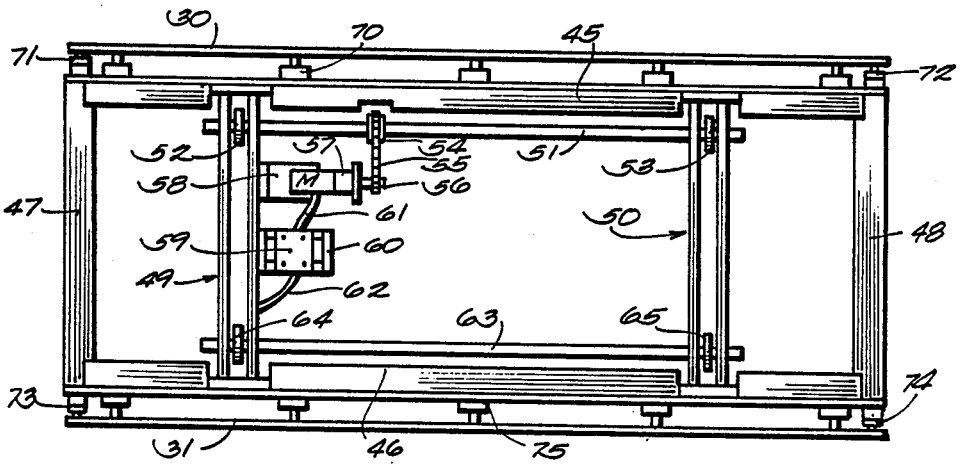
FIG. 4 is a diagram of an illustrative or typical carriage on which storage units are mounted for moving along tracks in the floor.

FIG. 4 is a plan view of an illustrative storage unit carriage with shelving removed. This carriage is conventional and is depicted to show that the carriage for each mobile storage unit is comprised of frame members 45, 46, 47 and 48 which form a rectangle. Parallel channel members 49 and 50 tie the opposite long sides of the rectangular carriage together along with end frame members 47 and 48. Each carriage has a drive shaft 51 on which flanged wheels 52 and 53 are fastened. The shaft 51 is journaled for rotation in bearings, not shown, mounted in cross frame members 49 and 50. The floor tracks on which the drive wheels run are not shown. The shaft 51 has a sprocket 54 fixed on it and it is driven through a chain 55 which is, in turn, driven by the sprocket 56 on the shaft of a reversible drive motor designated by the letter "M" and the reference numeral 57. Motor 57 is mounted on a bracket 58 which is mounted to one of the parallel cross members 49. The motor controller is represented by a rectangle marked 59 and it is mounted on a bracket 60. The cable providing power to the motor from controller 59 is marked 61. A cable that provides command signals to motor controller 59 is marked 62. Cable 62 runs back to the controller circuit depicted in FIG. 2 as will be evident later. Cable 62 contains move command signal conductors 193–195 which appear in FIGS. 2 and 3. The carriage also has a shaft 63 on which a pair of idler wheels 64 and 65 are fastened for running on the same tracks as power driven wheels 52 and 53.

The safety sweep bars are depicted diagrammatically in FIG. 4 and are marked 30 and 31. There is a set of five safety switches operable by sweep bar 30 and a typical one of these switches is marked 70. Sweep bar 30 is carried on yieldable mountings 71 and 72. The other sweep bar 31 is carried on yieldable mountings 73 and 74 and is mounted to actuate another group of series connected safety sweep switches which are typified by the switch marked 75. It will be evident that any obstruction encountered by a moving carriage will press sweep bar 30 or 31 and open all of the normally closed sweep switches on one side of the carriage or storage unit. Opening any of the sweep switches is detected through the controller on the unit carrying that sweep bar and, as a consequence, all carriages are stopped. The structure thus far described in reference to FIGS. 1 and 4, except for the safety leading edge tape switches, is described in the cited patent and is now known to those involved in designing and manufacturing movable storage units. Another possible exception compared with the cited patent is that the carriage drive motors 57 are dc rather than ac motors. In an actual embodiment, the motors are comprised of armature circuits and the field pieces are permanent magnets.

Figure 5:
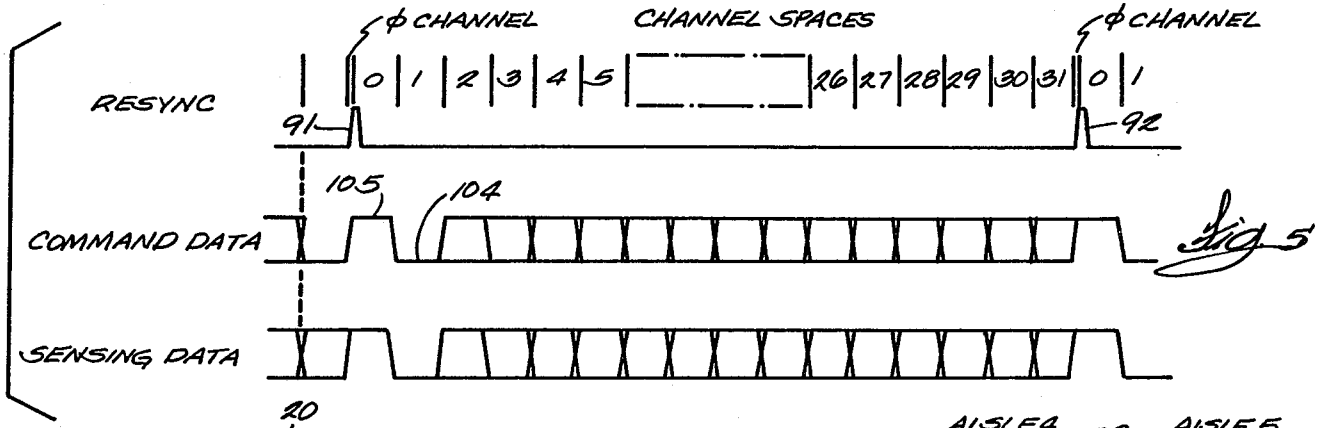
FIG. 5 is a timing diagram that is useful for explaining the manner in which digital data constituting commands are transmitted from a processor in a master controller on one of the movable storage units to slave processors and controllers on other of the storage units and how data pertinent to the status of each storage unit is sensed and returned to the master controller processor.
Figure 2:
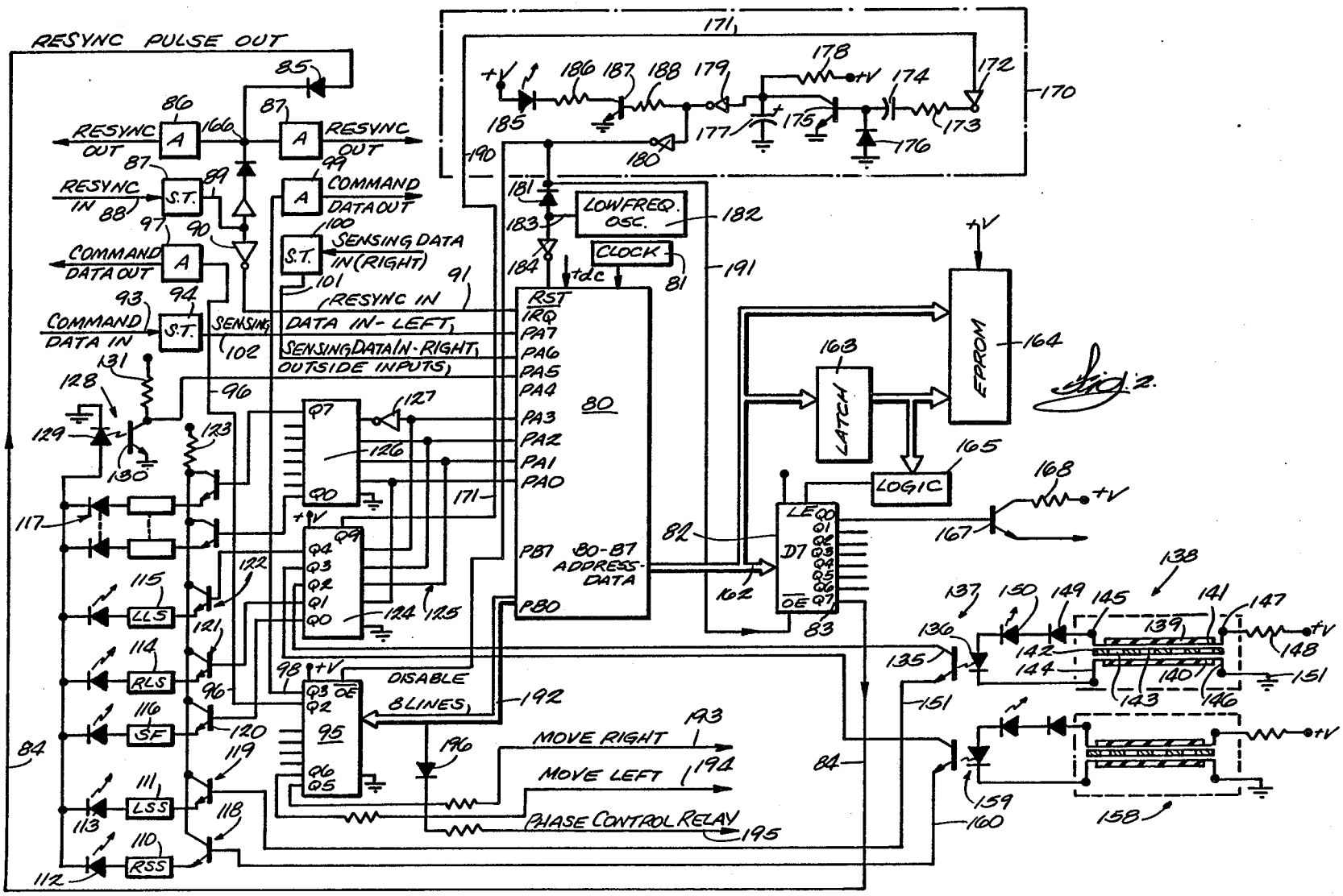
FIG. 2 is a partly block diagram and partly schematic diagram of the improved storage unit system controller.

Attention is now invited to the FIG. 2 circuit diagram which shows the elements of one of the microprocessor based controllers that is mounted on each storage unit. The functions of this circuit are basically the same as in the cited U.S. Pat. No. 4,437,711 but the controller contains improvements which will be discussed in detail later. The general features comparable to those in the cited patent will be briefly reviewed first. The heart of each controller is a microprocessor (hereafter called a processor) 80. In the improved embodiment, the processor generates 32 time slots of equal duration as compared with 16 time slots in the patent. Each time slot is, in this example, 1 ms long during which microprograms are executed by the individual processors. A resynchronizing pulse is sent out to all controllers at the start of every time slot sequence so that regardless of any possible disturbances in the circuitry, all controllers will be returned to synchronism in less than a second. The controllers on each unit read the logical state of each time slot during every processor cycle. A plurality of microprograms can be fetched and executed by each processor. During system operation, each processor is programmed to execute a series of microprograms, one after another, in time slots or channels into which the time interval between resync pulses is divided. Typical microprocessor 80 has an external 2 MHz clock 81. A logical one or high signal, for example, in a time slot that is assigned to a particular processor in a controller might be interpreted by that controller to cause its carriage to be the first to move to the right or left in an aisle opening sequence. This would result from the command data being originated in the controller on one of the storage units and being propagated simultaneously to all of the units. Similarly, the status of the limit switches, the safety sweep switches and the new leading edge tape switches falls within time slots to be read out and acted upon by the master controller. There are four lines that provide communication between the controllers on the various storage units. Assuming that the controller depicted in FIG. 2 is a master controller, the resync pulse will be generated in a digital data latch 82 located to the immediate right of processor 80 in the drawing. Disregarding for the moment the manner in which the resync pulses are generated, assume that they are generated by the processor and are output from a pin 83 on latch 82 and are transmitted by way of a line 84 around the diagram and through a diode 85 in the uppermost left region of the diagram to the inputs of pulse amplifiers 86 and 87 which are further designated by the letter "A". The resync pulses are output from these amplifiers, respectively, to the controllers on storage units that are located to the left and right of the controller depicted in FIG. 2. In the upper left region of FIG. 2 a block labeled S.T. constitutes a Schmitt trigger circuit 87 which in any controller has an input 88 for a resync pulse and an output line which leads to an inverter 90 which would return the resync pulse by way of line 91 to the interrupt request (IRQ) pin of processor 80. The Schmitt trigger circuits 87 sharpen the resync pulses in the controller of their reception. FIG. 5 shows a resync pulse 91 at the start of the zero channel or zero time slot and another resync pulse occurs, for example, at the end of the 32nd time slot which is marked 31 and is the last in the series of 0–31.

Handling the command data that is communicated from the controller and from one remote or movable controller to the next one on a storage unit will now be discussed in connection with FIG. 2. The serial digital command data is input to a typical control module by way of command data input line 93 in the upper left region of FIG. 2. Input is to a Schmitt trigger circuit 94. The output of high and low logical level serial command data is from a latch 95 which supplies, through a line 96, the input of an amplifier represented by the square labeled "A" and marked 97. The output of amplifier 97 goes to high and low logical levels in correspondence with the logical levels of the bits in the serial data falling within designated time slots. Amplfier 97 outputs the command data to the storage unit controllers to the left of the depicted controller. A line 98 running from an output pin on latch 95 leads to another amplifier 99 which outputs command data to controllers on storage units to the right of the one depicted in FIG. 2. It should be evident that any controller down the line from the system controller 37 in FIG. 2 can communicate with the next controller by way of a command data line.

Sensing data circuitry, which is also comparable to that in U.S. Pat. No. 4,437,711 will now be discussed in reference to FIG. 2. Sensing data flows in the direction from a controller that is most remote from the system controller to all intervening controllers and to the system controller. It should be recalled that all of the controllers are substantially the same except that one is designated to serve as a master and the others as slave controllers. Sensing data from units at the right of the controller in question is input to a Schmitt trigger circuit labeled S.T. and further identified by the reference numeral 100. The output line to the processor 80 from Schmitt trigger 100 is marked 101 and is labeled "sensing data in-right". Command data in by way of Schmitt trigger 94 is treated as "sensing data in-left" as indicated on line 102. Sensing data that is sensed is actually command data that is output from anyone of the processor based controllers on the individual storage units. The fact that a start button on one of the storage units is pressed would result in the controller on that unit producing a data bit in the proper time slot which would constitute a command and would be sensed by the processor on other storage units. This is but one example of what constitutes sensed data. All of the controllers must know that the other controllers want to execute a storage unit move sequence or take some measure in response to a failure or safety condition being violated.

The time slots correspond to digital data bits in the serial transmission format in FIG. 5. It will be noted that command data may consist of high and low logic levels in the various time slots going in both directions from a controller. By way of example and not limitation, if the time between consecutive resync pulses is 32 ms, the individual time slots will have a duration of 1 ms. If none of the start buttons on the movable units have been pressed, the system controller just waits and each processor resident in the controls on the other storage units just recycles through its consecutive microprograms between resync pulses but does nothing ordinarily. All controllers are sequencing through their time slots in synchronism. The sensing data function is basically the same as in cited U.S. Pat. No. 4,437,711.

An operational sequence will be briefly described now in reference to FIG. 2. Assume that the user desires to open aisle 4, for example, to access between storage units 22 and 23. Aisle 2 is presently open. Before any action is taken by the user, resync pulses are being transmitted to all controllers and processors on the individual storage units simultaneously. After each resync pulse consecutive test bits are transmitted during time slots 0 and 1 as explained in the next paragraph. Now assume that the user has pressed start push button switch which is on unit 22 and movable carriage 3 for the purpose of opening aisle 4. Storage unit 22 whose start switch has been operated, is also designated as the movable carriage decimal number 3. Its identification code word is thus, digital or binary 00011. The master controller must be informed that it is movable carriage 3 whose start push button has been activated. The identification is sent to the master controller by way of the sensing data line between movable units. Thus for binary number 00011, the sensing data bits for channels or time slots 2, 3 and 4 would be zeros and the time slots or channel spaces 5 and 6 would each be a logical 1. The master controller does not cause any of the storage units to move until a number of other conditions are met. For one thing, the master controller must see the same storage unit identification code repeated several times, three times by way of example, before the system controller treats the information as valid identification of movable carriage 3. The three read outs are stored and compared. If they agree, it reveals that they are likely to not simply be due to noise or invalid signals. Noise signals are more likely to be random than repeatable. This scheme reduces the effective electronic noise and enhances the safety of the system in that false starts are unlikely. When the master controller determines that the storage unit identification is valid, it sends out a command in corresponding time slot 7, for example, to each of the storage units in the system. The processors in the respective storage units read the series of data bits and store this information in their own memory as identification of the unit in which a start push button was pressed. Thus, a moment later when any controller must make a decision as to whether it should be the first to move and in which direction it should move, it can compare its own identification with the unit identification that has been transmitted to it from the master controller to determine if it will be involved in movement.

Even before the unit identification is transmitted, the master controller has been sending out the resync pulses and, during each time slot, the programs in the various modules have been running in correspondence with their assigned time slots at a very high rate but nothing has been happening. However, after each resync pulse, whether or not a start push button has been pressed, the master controller is sending out command bits which are for checking the integrity of the entire system. The first bit is a high level bit during time slot 0 as indicated by the bit marked 104 in FIG. 5. For example, assume that resync pulse 91 has occurred. This sets the timers in each of the processors in the respective controllers down the line to zero and timing begins. Two ms of time are counted off for channel zero in this embodiment. Thus, immediately after the sync pulse, the master controller sends out a logic high bit 105 which commands each mobile storage unit controller to send out an arbitrary high logic signal to the next unit to its right and each of the next units to the right looks for a high bit from the next module to the left. If no high level bit is received from the controller to the left, it indicates to the particular controller that there must be an open circuit or some other defect and the controllers all switch their logic to a state that inhibits movement by assuring that their drive motor remains deenergized. On the other hand, if the command data line is not interrupted the logic high command data bit in time slot 0 will be returned as sensing data to the master controller to indicate that one of the line integrity tests has been passed. Each controller stores the high bit if it has been received to be used later in deciding whether the carriage motor should be turned on by command bits in the higher order time slots. During the next time slot 1, testing is continued. During time slot 1, a low or logical zero command bit 104 is sent from the master controller. When the bit 104 in time slot 1 goes low, the individual controllers go through the same procedure as just described except that they put out a low logical signal on the command line to the next adjacent controller. Each controller again examines the incoming low bit command and it puts out a low command to the next unit to its right. Then each controller stores this information bit in its memory to be used during a later time slot to decide if its motor should be turned on or not. If, during time slot 1, the input to a controller is not low as that bit 104 should be, it is an indication that something in the system is supplying current when it should not be and is illegal and indicative of a defect. Thus, unless each controller has stored an indication that incoming command or test bit in channel 0 was high and the bit in channel 1 was low, none of the motors can be energized until the problem is corrected and the system is reset. It should be recognized that the check for the integrity of communications between controllers is made for every resync pulse during time slots 0 and 1. Hence, if any of the intercontroller communication circuits becomes open or becomes a current sink when it should not be, the system will lock out within a time no greater than the time between two successive resync pulses even if the storage units are in motion. Even if no start push button switch has been operated the test command bits will be sent out to check if the system is communicating. If not, system lockout occurs and no controller will issue a command to start its associated carriage drive motor.

Now, in connection with opening aisle 4, the system controller has verified that the identification is valid and not noise or some other spurious signal. Verification is complete during one of the channel 7 time slots and during the next cycle of time slots the system controller sends out the test bits assigned to channels 0 and 1 and follows it with transmission of the 5-bit unit identification code to all of the control modules during channels or time slots 2–6, for example. A high level command bit might then be transmitted in, perhaps, time slot 9. Whatever controller has had its start push button pressed would have this information in memory and would by comparison interpret the high level bit in channel 9 as being a condition which must be responded to by turning on the indicator lamp associated with the start push button that has been pressed. During existence of time slot 10, a low level bit or zero may be transmitted normally but this bit would go high in response to an emergency stop push button having been pressed. When the bit goes high, it is sent to all controllers as a command and as a sensed signal to the master controller which retransmits it during the next multiplex cycle and the processors in the various controllers respond by executing a microprogram that results in carriage drive motor operation in all of the units being inhibited. During other time slots, up to 32 slots in this example, additional microprograms are executed by the processors in the individual controllers. For instance, in one of the channels the microprograms may be executed for determining if the safety sweep switches on the units associated with the respective controllers are closed or open. If any is open, of course, the controllers respond by inhibiting motor operation. Similarly, in another time slot, each controller will check the state of the limit switches that are associated with it. Information indicative of whether a limit switch is opened or closed is retained in the memory on board the processor. Another of the time slots may have the assignment of a bit which the master controller was sent out as a high level command which can be read out by the individual movable storage unit controller to effectuate turning on and off lights 29 such as are indicated at the top of the various units in FIG. 1.

As mentioned earlier, the identification code for the unit on which a push button has been pressed for part of a second is now held in the memory on board each microprocessor. If by way of the sensing data lines, the master controller has been informed that all conditions for safe movement have been met, the master will send out to all slave controllers a "movement permissible" high logical command bit in one of the higher numbered time slots that will enable movement of all storage units that are to be driven and moved in order to open up the selected aisle. If movement is permissible, the motor control circuits, which will be discussed in more detail in reference to FIG. 3 later, will turn on and the motors will rotate in a direction in accordance with whether the motors are to drive the units to the right or left to open the aisle.

The controllers must decide whether they are to cause driving of their associated storage unit to the right or left to open the desired aisle. They have already stored a code word identifying the start push button that has been requested. The controllers compare their own 5-bit identification code with the code that has been stored. If a controller determines that its identification number is smaller than the carriage identification code number on the unit whose start push button has been operated to make the aisle opening request, that individual unit will be conditioned to move to the left provided its limit switches and its safety sweep switches are closed in the direction in which the movement is to take place. Thus, the example where aisle 4 is to open, storage unit 21 on movable carriage 2 would be the first to move since closure of its left limit switches has been sensed and its right limit switches are closed because aisle 3 is closed. All of the modules execute their microprograms for checking the state of the limit switches to which they relate during the same time slot or within 1 ms in the described embodiment.

Assuming that carriage 2 having storage unit 21 has begun to move, the left limit switches of storage unit 22 on carriage 3 will close. This is sensed by the controller on unit 22 by scanning the control circuits shown in FIG. 2 as will be explained momentarily. Carriage 2 and its storage unit 21 stop moving when its left limit switch is open due to unit 21 contacting unit 20, thereby closing aisle 2. Movement of carriage 3 and its storage unit 22 terminates when its left limit switches are opened as the result of unit 22 contacting unit 21.

The safety sweep switches, if there is more than one on each side of the storage unit which is the usual case, are all connected in series so that if any one of them were closed when it should not be this condition would be detected by the control module and sent as sensing data to the master controller. An instant later, after the next resync pulse, the master controller would send out a command to all slaves that would result in inhibiting movement of the carriages and all other operations. In accordance with the invention, the leading edge safety switch states are scanned by each processor concurrently with scanning the safety sweep switches.

Presently consideration will be given to the fact that the processor must know the status of a number of safety and control circuits such as the left and right safety sweep switches, the switch, if any, which will be caused to open if the weight of any object such as a person is resting somewhere on the floor, the right limit switch, the left limit switch and the leading edge safety switches on the unit on which the processor is mounted. By way of example, in the lower left region of the FIG.

2 diagram, the series connected right safety sweep switches and the left safety sweep switches are represented by the blocks labeled RSS and marked 110 and labeled LSS and marked 111. These circuits have light emitting diodes in series with them. These diodes are lighted if the switch circuits are closed when they should be and this is a useful aid to a service technician who is diagnosing a failure. The light emitting diodes are marked 112 and 113. Other circuits which must be checked continuously are the right and left limit switches represented, respectively, by the blocks labeled RLS and LLS and marked 114 and 115. The safety floor circuit is represented by the block labeled SF and marked 116. The latter three circuits discussed also have diodes in series with them. The diodes also serve the purpose of preventing any fault current from flowing reversely. Any number of additional circuits such as those indicated generally by the numeral 117 can be scanned by processor 80 and monitored. Each safety circuit is fed from a current source in the form of transistors such as those marked 118–122. The collectors of each transistor have a logic voltage applied through a current limiting resistor 123. The bases of transistors 118–122 are driven with a current supplied from a 4-to-8 line decoder 124. The four address lines to decoder 124 are collectively indicated by the numeral 125 and these lines are connected to address port pins PA 0–PA 3 on the processor 80. A decoder 126, similar to decoder 124, also receives its addresses from address port pins PA 0–PA 3 on processor 80. Decoder 126 is used for reading out the status of circuits which are generally designated by the numeral 117. Commands are not transmitted through these circuits. In an actual embodiment, additional circuits are scanned and monitored but in the drawing enough of them are shown to illustrate the procedure. With the particular decoders 124 and 126 used, inserting an inverter 127 in address line PA 3 permits using four address lines to drive two 4-to-8 line decoders.

Five of the eight output pins Q0 to Q4 are marked on decoder 124. The line from pin Q0 is connected to the base of transistor 120. The line from pin Q1 connected to the base of transistor 121. The line from pin Q4 is connected to the base of transistor 122. When these output pins on the decoder 124 switch to a high logical level, base current is supplied to the transistors and they turn on in a repeatable sequence so that a test current is supplied through the transistors to the outside loop circuits 114, 115 and 116. There are actually eight active outputs on decoder 124 but only five are being shown as in use for illustrative purposes. Only two outputs are illustrated as being used from decoder 126. When the typical series switch circuits 114, 115 and 116 are closed, they become conductive in correspondence with the decoder input addresses. When they conduct, that is, when the limit switches are closed for example, current is supplied to a current sensing circuit which is generally designated by the reference numeral 128. A very simple but adequate form of sensing circuit is shown and it comprises an optoisolator including a light emitting diode 129 and a phototransistor 130. The collector of this phototransistor is supplied through a collector resistor 131 which is energized from a logic voltage source. When the diode 129 conducts a pulse of current, phototransistor 130 turns on and the voltage at its collector drops to a logic low level. The collector is connected by way of a line labeled outside loop inputs to pin PA 5 on processor 80. When the processor is sending out the sequence of pulses through the outside circuits, it expects a return current or no return in the accordance with its microprogram. If, for example, a limit switch is open, the processor can detect non-return of the current pulse supplied from decoder 124 and take appropriate action such as to bring about deenergization of the carriage motor since the open limit switch indicates that one storage unit is driven up against the next one. Scanning is very rapid and continuous and both right and left limit switch circuits would be tested for continuity every millisecond or less.

The left and right safety sweep circuits 110 and 111 are scanned continuously similarly to the left and right limit switch circuits which were just described. Scanning the sweep circuits and circuits just discussed was done in the cited U.S. Pat. No. 4,437,711. However, in accordance with the invention, the safety sweep circuits are scanned indirectly in conjunction with the leading edge switches which are involved in novel circuitry.

The new leading edge safety switch circuit that utilizes a tape switch will now be discussed.

In FIG. 2, the Q2 output line from decoder 124 supplies the collector to emitter current of a photosensitive transistor 135 which, together with a light emitting diode 136 forms an optoisolator 137. One of the leading edge switches is illustrated diagrammatically and is within the boundaries of the dashed line rectangle 138. The leading edge switch is otherwise known as a tape switch. In the version obtained from the manufacturer, the tape switch is basically comprised of flexible strips of insulating material 139 and 140 which may actually be combined as a tubular element. The surfaces of strips 139 and 140 which face each other has conductive strips 141 and 146 bonded to them. The conductive strips on the insulating strips 139 and 140 are normally separated from each other by an insulating layer 142, somewhat similar to the separator in a membrane switch. The insulating strip 142 contains an array of holes or slots 143. Thus, if the outside insulating strips 139 and 140 are pressed toward each other, electric contact is made between the conductive strips 141 and 146 on each of the insulating strips. In the commercial version of the tape switch, the corresponding terminal ends 144 and 145 of the tape switch are not exposed but are buried in the insulating material. Thus, the usual commercially available tape switch is a normally open switch. For the purposes of the invention, the tape switch has been modified to not only have the terminals of the conductive strips 146 and 147 accessible but also to expose the previously mentioned normally unexposed end terminals 144 and 145. This permitted execution of the novel idea of making a normally open switch perform as if it were normally closed as has been done in accordance with the invention. It is inappropriate to use a normally open switch for detecting unsafe conditions because if there is a short circuit or inadvertently grounded line in the conductors leading to the terminals of the normally open switch, it is impossible to determine whether an intentional or at least, a contact that is to be detected has occurred in the normally open switch or whether it was a short circuit or other fault that caused the switch to appear being conductive. In the normally closed adaptation of the normally open tape switch as revised by applicant, a voltage is applied through a limiting resistor 148 from a dc voltage source. When the control system is operating, a series circuit is established beginning with resistor 148 and continuing through conductive strip 141, a protective diode 149, a light emitting diode 150 used for diagnostic purposes, light emitting diode 136 of the optoisolator 137, the other conductive strip on insulating tape portion 140 and finally to ground connection 151. As long as the LED 136 and the optoisolator 137 is conducting and emitting light, the collector to emitter circuit of phototransistor 135 will be capable of conducting the testing pulses in the sequence delivered under the influence of processor 80 from decoder 124. The emitter of phototransistor 135 is connected by way of a line 151 to the base of transistor 119 in the lower left corner of FIG. 2, which transistor supplies the test pulse to the input to the left safety switch 111 circuit. Assuming now that the test pulses are being coupled through phototransistor 135 in the optoisolator 137, they will also be coupled to the left safety switch circuit and then by way of current sensing circuit 128 they will be fed back through the outside loop input line to pin PA 5 of processor 80. The microprogram of the processor controls it to detect whether a line that it has addressed has conducted the pulse by determining whether there is coincidence between generation of the address to the decoder and return of the pulse to a processor port. If there is no return pulse when there should be, the processor 80 deduces that the circuit is open when it should be closed and it goes into a blocking state where no commands are issued. The left safety sweep switch circuit LSS 111 could be open or the negated normally open leading edge tape switch 138 could be closed. In this state, carriage motor operation in either direction is stopped by discontinuance of carriage motor activating signals to its controller which is shown in FIG. 3 and which will be described later.

If any part of the leading edge tape switch circuit is short circuited such as due to being touched by a person in an aisle, optoisolator 137 will not be excited to a conductive state by LED 136 in which case transistor 119 in the left safety sweep circuit LSS 111 will also not be switched to a conductive state and the test pulses that are caused to be delivered by the processor 80 addressing decoder 124 will not be returned through sensing circuit 128 to pin PA 5 of the processor. As mentioned, this will block all commands to the system. Inspection of the circuitry will reveal that a short circuit or an open circuit in the lines leading to the optoisolators or in the lines leading to and from the transistors 119 in the left safety sweep switch circuit will prohibit return of the test pulses and will bring about prevention of starting any aisle opening procedure and will bring any moving storage unit to a halt substantially instantaneously.

Normally open tape switches which applicant has adapted for use in the leading edge safety switch circuit are obtainable from the Tapeswitch Corporation of America in Farmingdale, N.Y. Long Island, N.Y.

The tape switch 138 on one aisle side of a particular storage unit has been described in association with other circuitry including the left safety sweep switch circuit 111. Another leading edge safety tape switch is on the opposite side of the movable storage unit and it is designated generally by the reference numeral 155. It functions identically to the circuit above it in FIG. 2. In this case, the test pulse from decoder 124 is output from its pin Q3 which connects to the transistor in optoisolator 159. In this case the pulse is delivered through the optoisolator transistor by way of line 160 to the base of transistor 118 in the lower left corner of the drawing. Transistor 118 turns on to couple the pulse to the right safety sweep switch circuit 110 or the pulse to be transmitted through current sensor 128 and back to the microprocessor on the outside loop input line which terminates in pin PA 5 of the processor.

At one instant in each complete cycle of processor 80 it sends out a nonexistent address to the decoders 124 and 126 in which case there should be no current returned to the processor through current sensing circuit 128 during a full scan of all circuits that are tested. If there is current return when there should not be for an address, a fault in the current sensor circuit 128 is indicated and the processor will do an unconditional shut down.

A Schmitt trigger circuit can be used as a current detector for switching test pulses back to the processor in place of optoisolator 128. In a commercial embodiment, a well known type of Schmitt trigger is actually used because it gives a sharp pulse and rejects more noise than an optoisolator.

The manner in which the resync pulses such as pulses 91 and 92 in FIG. 5 are generated will now be discussed. In the commercial embodiment, one machine cycle for processor 80 has a duration of one microsecond or one thousand nanoseconds. Data on the outputs of the processor can change every two hundred nanoseconds. A latch 82, to the right of processor 80 is involved in producing the resync pulses. Recall that between resync pulses in the system shown herein there are 32 time slots which contain high or low logic signals that are interpreted by the microprograms of the processors. An address/data bus 162 has its eight lines connected to pins B0–B7 of the processor 80. The bus provides addresses to latch 82 and to latch 163 and EPROM 164, too. EPROM 164 contains the microprogram for the associated processor 80. There is also working memory on board the chip in processor 80. The frequency and pulse width of the resync pulse is determined by the instruction set in EPROM 164. It is a software determination. If a certain address is written to latch 82 all the lines to latch 82 will be turned off except D7 which connects to the bus 162 and Q7 which is also designated by the numeral 83. Then if this address is written to a memory location, the line leading to the D7 input of latch 82 will fall back to logic zero in so many microseconds. So it is entirely within control of the software as to how long and when the resync pulse is generated. The data on the processor bus 162 is changing every two hundred nanoseconds, for instance, but during the write-to-memory cycle, logic circuitry 165 decodes the particular memory location on the address bus and issues the pulse at just the right instant to the latch enable (LE) pin of latch 82. So whatever exists on the microprocessor address/data bus at that instant is stored in latch 82 until the processor changes it and it stays and holds. Then after so many processor cycles, the processor changes the data again to define the length of the resync pulse.

As mentioned earlier, resync pulses are output from latch 82 by way of line 84 to a junction point which is marked 166 in the upper left hand corner of the FIG. 2 diagram. Before discussing utilization of the resync pulses, it may be noted that latch 82 has a plurality of output lines Q0 to Q7 which may provide signals for performing various functions in the system. For example, the Q0 output may lead to a transistor 167 which turns on and conducts from a power supply through its collector resistor 168 to an indicator lamp, not shown, which is in circuit with the emitter of transistor 167 and may turn on when a start button is pressed or when a unit is in motion a warning horn or bell, not shown, could also be driven through a transistor such as the one marked 167. The resync pulses are conducted in opposite directions from junction 166 to the inputs of the amplifiers 86 and 87 for being conducted to the processors on the respective storage units. As in FIG. 2, the resync pulse is input to the IRQ pin in processor 80. This provides for synchronizing all data to the sync pulses. When the resync pulses are inserted to the IRQ interrupt request pin, an unconditional interrupt occurs at each slave processor regardless of whether it is in or out of synchronism. Usually, there is hardly any loss of synchronism but it must be assured that there is no loss for more than a cycle or the processors will not deliver the proper data in the proper time slot.

The watchdog circuit which operates in a unique manner will now be discussed. First of all, consider that in the processor based system there should be a guarantee that all data is valid and that all data conducting loops are in proper condition. As explained earlier, a false or nonexistent address is sent repeatedly to test the current sense amplifier circuit or optoisolator 128 to be assured that the current sense amplifier has not failed. This is done every 32 milliseconds in the described embodiment. A result of transmitting the nonexistent address and concomitant test of the current sensing circuit ordinarily assures that the processor is running the microprograms correctly. However, a heavy burst of electronic noise could cause any processor to crash and start running meaningless portions of memory or issuing false commands. This should result in shut down of the system at least momentarily. The watchdog circuit for detecting and obtaining the proper response to software errors is shown contained within dash-dot rectangle 170 in FIG. 2. The input line to the watchdog circuit is marked 171 which can be seen to lead back from the input of an inverter 172 to decoder 124 at the left of processor 80. As explained earlier, this decoder is addressed from the address ports PA 0 to PA 3. The processor is programmed to cause one output pin Q9 on decoder 124 to produce pulses. By way of example and not limitation, in the described embodiment the output pulses from pin Q9 might occur every eight milliseconds and might have a width of one millisecond. If the pulses become erratic due to interfering electronic noise or software execution dropout or the like, the watchdog circuit 170 will sense it and it will cause the processor to shut down for a cycle and then to reset. Turning off and resetting will continue until the software error or interfering electronic noise disappears. Reset, which is the same as initialization of the processor 80 is obtained by applying a varying signal to the reset (RST) pin of processor 80. To reset the processor the RST pin is pulled low for a stabilization time and it is allowed to go to a high logic level again. If everything is all right and it was only swamping noise in the circuitry that upset the program, the microprocessor will reset as it would at start up or initialization. The pulses at an eight millisecond rate are delivered by way of line 171 to the input of inverter 172 in watchdog circuit 170. The pulses pass through a resistor 173 and they are ac coupled by a capacitor 174 to the base of a transistor 175. A diode 176 is connected to ground as shown. Every pulse that comes in charges capacitor 174 and turns on transistor 175 for the pulse duration. Diode 176 conducts between pulses to, in effect, discharge coupling capacitor 174 so it can transmit the next input pulse. An integrating capacitor 177 is connected to the collector of transistor 175 and to a resistor 178 which is supplied from a voltage source. Capacitor 177 attempts to charge through resistor 178 but if the pulses are coming into the watchdog circuit at the specified rate, transistor 175 will cause discharge of capacitor 177 by conducting in response to each pulse. If the pulses become erratic or are missing, transistor 175 turns off long enough to permit capacitor 177 to charge up to about 63% of its supply voltage in about 33 milliseconds. The charge on capacitor 177 is sensed as a high logical voltage by the input of inverter 179 and its output pin goes low. Then the output pin of an inverter 180 goes high or to a logical one level. The output pin of inverter 180 was normally pulling the cathode of a diode 181 to ground when the output of inverter 180 was at a logical low as when the watchdog pulses were coming in every eight milliseconds so capacitor 177 never fully charged to logical high level voltage. When the output pin of inverter 180 goes to logical one, it stops diode 181 from conducting. This turns on a low frequency oscillator which is represented by the block marked 182 and is implemented with a classical multivibrator circuit, not shown. In the illustrated embodiment, oscillator 182 outputs pulses at 1 Hz on its output line 183. This makes the output pin of the next inverter 184 go alternately high and low in which case the reset (RST) pin of processor 80 goes to a high and low logical level at 1 Hz. As mentioned, pulling pin RST low for a stabilization time and letting it go high again effects reset of processor 80. If the disturbance that resulted in capacitor 177 of the watchdog circuit charging disappears, the microprocessor will reset and begin executing its program again. Charging pulses from decoder 124 will then again be fed into the watchdog circuit 170 to keep it deactivated. Thus, synchronism can be restored to the microprocessor system if it is swamped with noise or with soft errors constituting misexecution of the instruction code itself. A unique feature of the watchdog circuit used herein is that it constantly tries to restart the processor and restore synchronism. This is highly advantageous over a system that would simply lock out the processor in response to occurrence of swamping electronic noise or misexecution of a program.

If significant electronic noise occurs while the carriages are in motion in an aisle opening procedure, the system may shut down for a second because some of the variables that indicate which unit was running, why it was running, the status of the safety sweep and limit switches and so forth may get cleared out. The units would stop moving and the operator would have to press the start push button on the unit again. If there is substantial interfering noise or drop out when the carriages are parked and not moving, there would simply be a reset and in one second everything would be ready for operation again.

The watchdog circuit also includes a light emitting diode marked 185. Its anode is connected to a positive voltage source. It is in series with a resistor 186 and the collector-emitter circuit of a transistor 187. The base of transistor 187 is supplied through a resistor 188 from the output pin of inverter 179. This output is at a logical high level as long as capacitor 177 does not fully charge. As a result, there is drive current to the base of transistor 187. It is conductive and the LED 185 lights up. Seeing 185 on would indicate to a service person that the processor 80 software is executing correctly. If LED 185 is off, a service person who has come to determine why the system stopped would simply remove the circuit board in which the processor and its peripherals are mounted and replace it with a new board.

If a hardware failure has occurred, attempting to reset the microprocessor occurs but it may jump into executing the wrong instructions again. A latch or memory could break down or the microprocessor itself could fail. In such case the watchdog circuit will detect it because there will not be the consecutive pulse input to the watchdog circuit at the right time, so the check LED 185 will stay off. The low frequency oscillator will continue to gate the reset pin of the microprocessor up and down. There could be a stream of bus errors, read errors out of the microprocessor, and so forth. The watchdog circuit will detect this and the program will crash but the program is repeated every 32 milliseconds in the embodiment being described.

A unique scheme is used for assuring that, in case of a failure, a controller cannot issue commands to the outside world. For instance, a dangerous situation could arise if the processor or its associated hardware failed in such a way that the processor delivered a sustained command for the storage units to be driven to the right. A transistor failure in a microprocessor might cause such a false command even though the microprocessor was supposedly locked out. To make sure that no commands can get out if there is a haradware failure, an output disable signal is transmitted from the output of inverter 180 in the watchdog circuit, by way of line 190, to the active low output enable (OE) pin of latch 95 in the lower left region of the drawing. This latch outputs the move right and move left command data and other command data. Thus, latch 95 becomes blocked in response to receiving a disable signal and the controller is essentially isolated from the outside world. A disable output signal from the output pin of inverter 180 in the watchdog circuit is also transmitted by way of line 191 to the OE pin of latch 82 so that the outputs of that latch are also disabled in response to the high logical level output disable signal. Thus, the watchdog circuit stops everything even the resync pulses and the whole system is inactivated.

The matter of controlling the direction and speed of the storage unit carriage drive motors and of controlling the acceleration, deceleration and braking rate of the drive system will now be discussed primarily in reference to FIG. 3. First, note, that in the FIG. 2 circuit diagram there are two lines 193 and 194 which are labeled as being indicative of their carrying the move right and move left commands to the FIG. 3 circuit. These lines are output of latch 95. Another line 195, labeled phase control relay, is taken directly from one of the lines in the bus 192 and this line has to do with controlling the speed of the carriage drive motors. There is a protective diode 196 in the phase control relay line 195.

Attention is now invited to FIG. 3. The command signals to move right and left and to change phase or motor speed come up on lines 194, 193 and 195 respectively, and these correspond to the same lines on FIG. 2. In FIG. 3 a relay coil labeled L and marked 200 is energized in response to input of a sustained move left command signal on input line 194. A relay labeled R and marked 201 is energized in response to a sustained move right command signal that is input on line 193. Adjacent normally closed contacts labeled R and 202 and L and 203 are interlocked as indicated by the dashed line between them so that when relay coil 200 is energized, contact 203 will open and contact 202 will remain closed. When relay coil 201 is energized, contact 202 opens and 203 remains closed. The phase control relay coil is labeled P and is marked 204. This relay is involved in stepping down the motor speed in two steps when the moving storage unit carriage is approaching the end of its travel and before the limit switches are operated.

The command signal input circuits are all the same. Consider the move left command. It is supplied to a optoisolator 205 which has a light emitting diode in line 194 and a diac in proximity with the diode. The photosensitive diac becomes conductive when light is emitted by the diode and this would bring about energization of move left relay coil L or 200. Energization of relay coil 200 will cause dc carriage motor 57 to run in a direction that results in left movement of the carriage as will be explained in more detail soon. A resistor 206 and a capacitor 207 are connected in series across the input and output terminals of the diac to suppress transients. The diac circuit is supplied with low ac voltage on terminal 208. A common return line 209 for the relays runs to one of the secondary terminals 210 on a step-down transformer T 1. This transformer is for supplying various control voltages such as the rectified and regulated logic level voltages.

The move right relay control circuit and the phase control circuit and the phase control relay are similar to the control circuit just described and they include optoisolators 210 and 211 and suppression circuits 212 and 213.

The carriage drive motor 57 appears in the upper right region of FIG. 3. Carriage drive motors for movable storage units have traditionally been ac motors but a dc motor is used in this case. The motor has an armature 214 and permanent magnet field pieces 215 rather than having dc field coils. By way of example, and not limitation, the motor used in the commercial embodiment has a voltage rating of 90 volts dc. There are a pair of conductors 216 at the left of FIG. 3 which connect to the power mains. Typically this would be a 120 volt ac input. Power from the mains is supplied to the input of a unit labeled Accel.-Decel. represented by the block marked 217. This unit has the capability of permitting setting of the maximum and minimum speed of the dc motor and of controlling the acceleration and deceleration rate of the motor but it has no provision for causing a dc motor to run reversibly. The FIG. 3 circuit includes the necessary alternately operable contacts which bring about reversal of the current direction through the armature of the motor and, hence, reversal of the motor. Unit 217 is commercially available. The units used in the commercial embodiment are obtained from KB Electronics of Brooklyn, N.Y.

Assume that a command signal comes in on 195 to cause movement of a particular carriage and storage unit to the left. The command signal will energize the L relay coil 200. This will close normally opened contacts LC 1 and LC 2. Then the positive side of the output terminal A+ will be fed through lines 218 and 219 to the right brush 220 on the right side of the dc motor armature. The current is returned to the A− terminal on the control unit 217 by way of left brush 221 on the motor armature, line 222 and presently closed relay contact LC 1. Let us say that this causes the motor armature to rotate counterclockwise when the storage unit is moving to the left.

When a move right command signal is supplied by way of line 193, relay coil 201 is energized and left interlock contact 202 is opened. Energization of relay coil 201 causes closure of relay contacts RC1 and RC2 which are associated with right movement of a storage unit carriage. The current flow through the motor armature will now be reversed as compared to the when the move left relay coil 200 was energized. Reversing the direction of the armature current, of course, reverses the direction of armature rotation. For right movement, the circuit is from the A+ terminal on control unit 217 through RC1, line 222, brush 221 and back to A− by way of brush 220, line 219 and presently closed contact RC2. The motor reversing circuit just described is, of course, conventional in that it automatically performs as a double-throw double-pole switch. A circuit containing a resistor 223 in series with a capacitor 224 is connected between lines 219 and 222 for the purpose of suppressing sparking when the contacts open.

A new feature in FIG. 3 is a dynamic braking circuit which contributes to smooth and safer stopping of a moving storage unit. The unusual feature of the dynamic braking circuit is a variable dynamic braking feature which is not known to have been used in movable storage unit controls heretofore. The dynamic braking circuit allows setting the intensity of the braking effect commensurate with the mass of the storage units or the load on the storage units which exists in any particular installation. The dynamic braking circuit includes two normally closed relay contacts RDB 1 and LDB 1. RDB 1 contact opens when move right relay coil 201 is energized. LDB 1 contact opens when move left relay coil 200 is energized. These contacts are always connected in series with at least one resistor 225. This would, of course, result in a short circuit across the armature supply so one or the other of the contacts RDB 1 or LDB 1 must be opened when the motor is being driven. At the end of a operating cycle, whichever contact of RDB1 or LDB1 has been open, closes. Concurrently, of course, the contacts RC1, RC2 or LC1, LC2 whichever pair were closed will open. With RDB1 and LDB1 closed, current regenerated by the rotating armature of the motor can always flow through RDB1, resistor 225 and LDB1 to effect a short circuit across the armature and to cause a counterforce which slows the armature down and stops it. Resistor 225 is the highest valued resistor in the group consisting of resistors 225, 226 and 227. When only resistor 225 is connected across the motor armature, the dynamic braking effect is minimum. Resistor 226, in a practical embodiment by way of illustration and not limitation, has a value of about one-half the ohmic value of resistor 225. Resistor 226 is connected for being in parallel with resistor 225 and the lowest ohmic value resistor 227 at the option of a user who uses a selector switch 228 to make the choice of whether there should be one resistor by itself in the dynamic braking circuit or two resistors in parallel to obtain the desired intensity of dynamic braking commensurate with the total mass of the storage units and their prospective loads. Switch 228 has a movable contact 229 and stationary contacts 230 and 231. When movable contact 229 is in neutral position as shown in FIG. 3, when both contacts RDB1 and LDB1 close after motor deenergization, dynamic braking current flow is through a circuit beginning with a motor brush, and continuing through contact RDB 1, resistor 225, LDB 1 contact and the line meet back to the other motor brush. If, at the time the movable storage unit system is installed, it appears that the load will be heavy enough, resistor 226 will be connected in parallel with resistor 225. This is accomplished by switching the blade 229 in switch 228 to make contact with stationary contact 230. Now the lower combined resistance of resistors 225 and 226 will constitute a lower resistance on the armature and more intensive braking will result. The most intense braking is achieved by connecting the lowest ohmic valued resistor 227 in parallel with resistor 225. This is accomplished by moving switch blade 229 in contact with contact 231 of switch 228. Practical experience reveals that providing three steps of dynamic braking resistance will provide a range of dynamic braking intensities correlated with the mass of the storage units and their loads in most installations. The values of the resistors will depend on the size of the carriage drive motors and their loads.

Another feature of the invention is providing for adjusting the rotational speed of all the carriage motors to match each other so one unit will not overtake nor lag behind another during an aisle opening procedure. The units moving away from an aisle that is to be opened should have the leading unit move first and as soon as its limit switch is cleared, the next unit should move and then the next one, and so forth. All units should move at the same rate so that they start moving in a uniform sequence, move at uniform speed and stop in a uniform sequence. Even if identical models of dc permanent magnet motors are used on the various carriages, the motors may have different speed characteristics. This may be due to slightly different magnetic field strengths in the permanent magnets or just a little bit of geometrical difference between the pole pieces and the armature in one motor as compared to another. The problem of obtaining uniform motor speeds has been solved with the circuit in FIG. 3 including normally closed contact PA 1, normally open contact PA 2, resistors 232 and 233 and a potentiometer 234. In a practical embodiment, ohmic value of resistor 232 is about four times as great as the ohmic value of resistor 233. When the phase control relay coil P or 204 is energized concurrently with generation of a move right or move left command, contact PA 1 opens and PA 2 closes so that full power is applied to the motor and it runs at its highest speed. When the aisle opening operating sequence is completed, as will be explained, PA 1 closes and PA 2 opens again the motor 57 will slow down a step in one second in this design. Potentiometer 234 allows for compensating the dc motor for variances in the same models and ratings as indicated above. The potentiometers for setting maximum and minimum speed are built into the unit 217. The circuit including the contacts PA 1 and PA 2 was invented by applicant to achieve uniform motor speeds. This circuit is, in effect, paralleled with the variable resistances which are not shown and which are in the unit 217 for setting maximum and minimum motor speed by manual adjustment. In operation, the Accel-Decel 217 control will take about one second to ramp or accelerate the motor 57 to maximum speed when L relay 200 or R relay 201 is energized. The control, of course, does not ramp down or decelerate until it receives a command. So, during the carraige stopping action under the control of processor 80 in FIG. 2, the phase control relay in FIG. 3 is switched from full power to part power. This is done by dropping out the phase control relay 204 which switches the motor control from maximum to minimum speed setting. This takes about another second to ramp down to the lower speed. In this case, the storage unit will travel home to the point where its limit switch opens and at that point the left move relay coil 200 or the right move relay coil 201, as the case may be, is deenergized. Upon this event, one or the other of relay contacts RDB 1 or LDB 1 which has been opened during driving of the carriage motor closes and dynamic braking of the selected intensity takes effect. So there is an automatic deceleration step before the motor is deenergized.

I claim:

1. A storage system comprising a plurality of movable storage units, reversible motor means mounted to said movable units, respectively, for driving each unit selectively in one direction or the opposite direction to open an aisle between a pair of said units, motor control circuit means for each unit connected to said motor means on the unit, controller means including processor means on the units, respectively, and conductors interconnecting said controller means, start switch means on each unit for selecting opening of an adjacent aisle, said start switch means connected to said interconnected controller means on the same unit and manually operable to activate one of said processor means in said controller means to produce command signals to which the processor means in at least one other controller means responds by providing command signals to said motor control circuit means for causing said circuit means to turn on one or more motor means for driving one or more units in directions that result in opening the selected aisle, tape switch means mounted to at least one side of each of said movable units and extending over substantially the length of the unit, said tape switch means comprising an elongated support composed of flexible insulating material and elongated conductive strips constituting switch contacts mounted to said support in spaced relation to provide normally open switch contacts, test circuit means for conducting test pulses that are caused to be generated by said processor means at a predetermined frequency back to said processor means, said test circuit means including test circuit switch means, said processor means responding to said test circuit switch means becoming nonconducting so as to interrupt said pulses by commanding said motor control circuit means to deactive said motor means to stop movement of the unit, safety sweep bar means mounted to the sides of said movable storage units and a plurality of normally closed safety sweep switches arranged for being opened in response to said bar means encountering an obstruction when the unit on which said bar means is mounted is moving, said safety sweep switches being connected in series with each other in said test circuit means so that if any sweep switch opens said test pulses applied to said sweep switches will not return to said processor means, one pair of corresponding ends of said strips in said tape switch means being connectable to an electric power source and a circuit loop connected across the other pair of corresponding ends, said circuit loop including optoisolator means for controlling said test circuit switch means in said test circuit means during a safety sweep test pulse so that said test circuit switch means remains conducting as long as said loop is conducting and becomes nonconducting when said contacts in said tape switch are in contact and said loop is short circuited and nonconducting, said optoisolator having the light emitting diode thereof connected in said circuit loop and the photosensitive transistor thereof connected in said test circuit means.

2. The system according to claim 1 including:

a transistor having a terminal for connecting to an electric power source and terminal connected to the said circuit including said series connected safety switches, said transistor having a control element connected to said means in said circuit loop for controlling conductivity of said test circuit means.

3. A storage system comprising a plurality of movable storage units, reversible motor means mounted to said movable units, respectively, for driving each unit selectively in one direction or the opposite direction to open an aisle between a pair of said units, motor control circuit means for each unit connected to said motor means on the unit, controller means including processor means on the units, respectively, and conductors interconnecting said controller means, start switch means on each unit for selecting opening of an adjacent aisle, said switch means connected to said interconnected controller means on the same unit and manually operable to activate one of said processor means in said controller means to produce command signals to which the processor means in at least one other controller means responds by providing command signals to said motor control circuit means for causing said circuit means to turn on one or more motor means for driving one or more units in directions that result in opening the selected aisle, decoder means having address code input lines connected to said processor and having a plurality of output lines on which a sequence of output test signals are repeatedly transmitted, respectively, in correspondence with the output line that is addressed, a plurality of circuits including test signal conducting circuits containing safety sweep switches and circuits containing limit switches and means coupling inputs to said circuits to said output lines, respectively, of said decoder means, current sensor means having an input to which the outputs of said test signal conducting circuits are connected in common and having an output coupled to said processor for returning said test signals to said processor, said processor sensing for coincidence of said transmitted signals and the corresponding returned signal to determine the conductive states of said test signal conducting circuits, said processor also sending out in said sequence of addresses an invalid address to a circuit that does not exist such that if a test signal is returned to said processor coincidentally with issuance of said invalid address, said processor will determine that said current sensor means is defective and will respond by causing said controllers to deactivate the system.

* * * * *

UNITED STATES PATENT AND TRADEMARK OFFICE

CERTIFICATE OF CORRECTION

PATENT NO. : 4,733,923

DATED : March 29, 1988

INVENTOR(S) : Dean L. Dahnert

It is certified that error appears in the above-identified patent and that said Letters Patent is hereby corrected as shown below:

Column 21, Line 49 Delete "deactive" and substitute therefor ---deactivate---

Signed and Sealed this

Eighteenth Day of October, 1988

*Attest:*

DONALD J. QUIGG

*Attesting Officer*

*Commissioner of Patents and Trademarks*